US009512835B2

(12) United States Patent
Casella

(10) Patent No.: US 9,512,835 B2
(45) Date of Patent: Dec. 6, 2016

(54) HIGH PRESSURE BELLOWS ASSEMBLY

(71) Applicant: Alloy Bellows and Precision Welding, Inc., Highland Heights, OH (US)

(72) Inventor: Greg Casella, Deland, FL (US)

(73) Assignee: Alloy Bellows and Precision Welding, Inc., Highland Heights, OH (US)

( * ) Notice: Subject to any disclaimer, the term of this patent is extended or adjusted under 35 U.S.C. 154(b) by 421 days.

(21) Appl. No.: 14/069,625

(22) Filed: Nov. 1, 2013

(65) Prior Publication Data

US 2014/0219842 A1 Aug. 7, 2014

Related U.S. Application Data

(60) Provisional application No. 61/721,209, filed on Nov. 1, 2012.

(51) Int. Cl.

| | |
|---|---|
| ***F01B 19/00*** | (2006.01) |
| ***F04B 45/02*** | (2006.01) |
| *F04B 45/00* | (2006.01) |

(52) U.S. Cl.

CPC ..... *F04B 45/02* (2013.01); *F04B 45/024* (2013.01); *F04B 45/00* (2013.01); *Y10T 29/49236* (2015.01)

(58) Field of Classification Search

CPC ..... F04B 45/024; F04B 45/02; F15B 7/00

See application file for complete search history.

(56) References Cited

U.S. PATENT DOCUMENTS

| | | | | |
|---|---|---|---|---|
| 4,532,766 | A | 8/1985 | White et al. | |
| 5,474,303 | A | 12/1995 | Coles | |
| 5,662,335 | A | 9/1997 | Larsen | |
| 6,182,684 | B1 | 2/2001 | Frankenberg | |
| 7,373,972 | B2 | 5/2008 | Ocalan | |
| 2010/0186843 | A1* | 7/2010 | Wellner | F15B 1/103 138/30 |
| 2012/0211112 | A1* | 8/2012 | Barth | F15B 1/02 138/30 |
| 2013/0032226 | A1 | 2/2013 | Salihbegovic | |

* cited by examiner

*Primary Examiner* — Thomas E Lazo
*Assistant Examiner* — Daniel Collins
(74) *Attorney, Agent, or Firm* — Roger D. Emerson; Emerson Thomson Bennett

(57) ABSTRACT

A high pressure bellows assembly is disclosed herein. The high pressure bellows assembly includes a first bellows being reversibly expandable. The high pressure bellows assembly also includes a second bellows being reversibly expandable. The high pressure bellows assembly also includes a chamber including a first portion encircling the first bellows, a second portion including an interior of the second bellows, and a third portion placing the first and second portion in fluid communication.

18 Claims, 3 Drawing Sheets

HIGH PRESSURE BELLOWS ASSEMBLY

CROSS-REFERENCE TO RELATED APPLICATIONS

This application claims the benefit of U.S. Provisional Patent Application Ser. No. 61/721,209 for a HIGH PRESSURE BELLOWS ASSEMBLY, filed on Nov. 1, 2012, which is hereby incorporated by reference in its entirety.

BACKGROUND OF THE INVENTION

1. Field of the Invention

The invention relates to an apparatus for actuating a deep-sea drill.

2. Description of Related Prior Art

U.S. Pat. No. 5,662,335 discloses a pressure balanced bellows seal. The bellows seal includes a seal bellows assembly which is operatively and sealingly attached to the valve stem, a counterbellows assembly which is substantially concentric with the seal bellows assembly, a midplate which operatively joins the seal bellows assembly and the counterbellows assembly in an end-to-end arrangement and an inert fluid within the cavity formed by the seal bellows assembly and the counterbellows assembly and which is moveable therebetween to compensate for volumetric changes resulting from the axial movement of the valve stem. The inert fluid balances the pressure of the process fluid and distributes it substantially uniformly against the seal bellows assembly and the counterbellows assembly thus substantially eliminating any pressure stresses within the bellows assemblies.

U.S. Pub. No. 2013/0032226 discloses a GAS LIFT VALVE HAVING EDGE-WELDED BELLOWS AND CAPTIVE SLIDING SEAL. A gas lift apparatus has a gas lift valve that disposes in a mandrel. A housing of the valve has a chamber, and a seat disposes between the inlet and outlet. A piston movably disposed in the housing has one end exposed to the chamber. A distal end can selectively seal with the seat to close the valve. A first edge-welded bellows disposed on the piston separates the inlet and chamber pressures and can fully compress to a stacked height when the distal end of the piston seals with the seat. A dynamic seal can be achieved at closing by using a captive sliding seal between the piston's distal end and the seat. A second edge-welded bellows can also be disposed on the piston, and the two bellows can operate in tandem. Oil filing the interiors and the passage can move from one bellows to the other to transfer the pressure differential between the inlet and the chamber pressures. The second bellows fully compresses to a stacked height and stops opening of the valve.

SUMMARY OF THE INVENTION

In summary, the invention is a high pressure bellows assembly. The high pressure bellows assembly includes a first bellows being reversibly expandable. The high pressure bellows assembly also includes a second bellows being reversibly expandable. The high pressure bellows assembly also includes a chamber including a first portion encircling the first bellows, a second portion including an interior of the second bellows, and a third portion placing the first and second portion in fluid communication.

BRIEF DESCRIPTION OF THE DRAWINGS

The following detailed description is best considered in connection with the accompanying drawings.

DETAILED DESCRIPTION OF EXEMPLARY EMBODIMENTS

Figure 1:
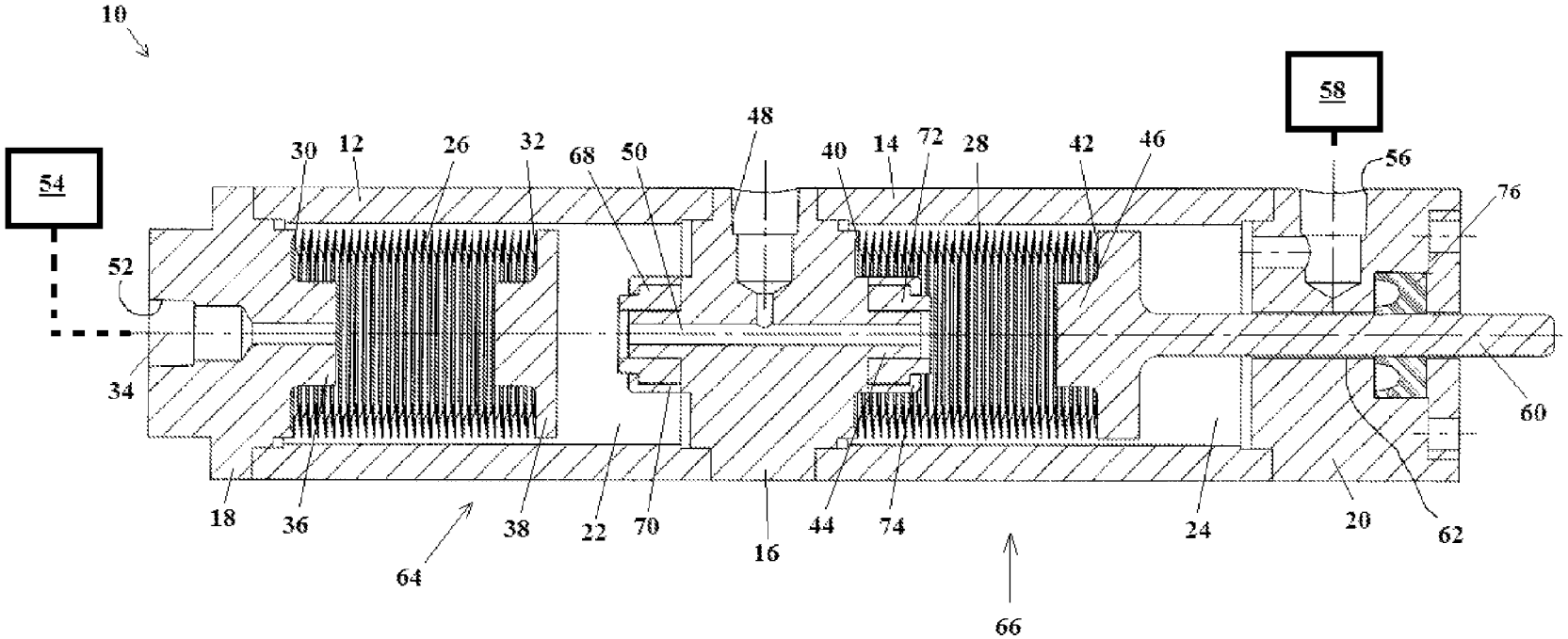
FIG. 1 is a cross-section of an exemplary embodiment of the invention.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention, as demonstrated by the exemplary embodiments described below, provides an improved actuator for operating environments in which a bellows is applied to move another structure and, further, in which the bellows may be subjected to relatively high pressure.

FIG. 1 shows a first exemplary high pressure bellows assembly 10. The exemplary assembly 10 includes first and second housings 12, 14. The exemplary first and second housings 12, 14 can be cylindrical. The exemplary assembly 10 can also include a manifold 16 interconnecting the first and second housings 12, 14. The manifold 16 can be welded to both of the first and second housings 12, 14. Other methods and arrangements for interconnecting the first and second housings 12, 14 and the manifold 16, both releasibly and permanently, can be applied in embodiments of the invention.

The assembly 10 can also include first and second end caps 18, 20. The end cap 18 can engage an end of the housing 12 opposite to the manifold 16. The housing 12, the end cap 18, and the manifold 16 can cooperate with one another to define at least part of a first chamber 22. The end cap 20 can engage an end of the housing 14 opposite to the manifold 16. The housing 14, the end cap 20, and the manifold 16 can cooperate with one another to define at least part of a second chamber 24. The end caps 18, 20 can be releasibly or permanently engaged with the respective housing 12, 14.

The assembly 10 can also include first and second bellows 26, 28. The first bellows 26 can be positioned within the first housing 12 and extend between first and second ends 30, 32 along a central axis 34 of the assembly 10. The first end 30 can be fixedly engaged with the end cap 18 and be sealed with respect to the end cap 18. A spout 36 can be integrally formed with the end cap 18 and project into the first end 30 of the first bellows 26. A first valve member 38 (or valve closing member) can be sealingly engaged with the second end 32. The bellows 26 can expand as fluid is received internally.

The second bellows 28 can be positioned within the second housing 14 and extend between first and second ends 40, 42 along the central axis 34 of the assembly 10. The first end 40 can be fixedly engaged with the manifold 16 and be sealed with respect to the manifold 16. A spout 44 can be integrally formed with the manifold 16 and project into the first end 40 of the second bellows 28. A second valve member 46 (or valve closing member) can be sealingly engaged with the second end 42. The bellows 28 can expand as fluid is received internally.

The manifold 16 can include a port 48. Incompressible fluid can be directed into the chamber 22 through the port 48 and the port 48 can then be sealed. The exemplary chamber 22 can include a first portion defined by the housing 12 and encircling the first bellows 26. The exemplary chamber 22 can also include a second portion defined by a passageway 50 extending through the manifold 16. The exemplary chamber 22 can also include a third portion being the interior of the second bellows 28. As will be set forth more fully below, the first, second and third portions of the chamber 22 can be selectively closed from one another.

A passageway 52 can extend through the end cap 18. The passageway 52 can extend through the spout 36 to fluidly communicate with the interior of the first bellows 26. A fluid delivery system, referenced schematically at 54, can be used to selectively direct pressurized fluid to the passageway 52 and thus to the interior of the first bellows 26. Fluid can be selectively directed into the interior of the first bellows 26 and selectively allowed to exit the interior of the first bellows 26.

A passageway 56 can extend through the end cap 20. The passageway 56 can fluidly communicate with the chamber 24. A fluid delivery system, referenced schematically at 58, can be used to selectively direct pressurized fluid to the passageway 56 and thus to the chamber 24. It is noted that in some embodiments of the invention a single fluid delivery system can be applied; the fluid delivery systems 54 and 58 can be sub-systems of single, comprehensive system controlled by a single controller. Fluid can be selectively directed into the chamber 24 and selectively allowed to exit the chamber 24.

The second valve member 46 can be integrally-formed with or engaged to a rod 60. The rod 60 can project through a passageway 62 in the end cap 20. The rod 60 can be engaged with a deep sea drill bit (not shown). Extension of the rod 60 out of the assembly 10 (to be described in detail below) urges the drill bit forward, such as to engage the sea bed. Retraction of the rod 60 into the assembly 10 draws the drill bit back, such as out of engagement with the sea bed.

In operation, the rod 60 can be extended by directing fluid through the passageway 52 and spout 36, into the first bellows 26. The first bellows 26 expands in response and the valve member 38 is urged toward the manifold 16 along the axis 34. As a result, fluid in the chamber 22 is urged through the passageway 50 and into the interior of the second bellows 28. The second bellows 28 expands in response and the valve member 46 and rod 60 are urged toward the end cap 20 along the axis 34.

When it is desired to retract the rod 60, fluid can be directed through the passageway 56, into the second chamber 24. The second bellows 28 collapses in response and the valve member 46 is urged toward the manifold 16 along the axis 34. As a result, fluid in the third portion of the chamber 22 (the interior of the second bellows 28) is urged through the passageway 50 and into the interior of the housing 12. The first bellows 26 is collapsed in response and the valve member 38 is urged toward the end cap 18 along the axis 34.

The assembly includes first and second valves 64 and 66 to protect the bellows 26 and 28 from damage that can arise when large pressure differentials arise between the outside and inside of either of the bellows 26, 28. The first valve 64 can include the valve member 38 and a valve seat 68. The valve seat 68 can be mounted on the manifold 16 and cooperate with the valve member 38 to selectively close the passageway 50. The valve seat 68 can be fixed to the manifold 16 with a collar 70. In operation, the valve member 38 can be urged along the axis 34 toward the manifold 16 until the valve member 38 contacts and seats on the valve seat 68, closing the passageway 50. In the exemplary embodiment, the valve member 38 is a single, integrally-formed structure that serves two purposes: closing an end of the bellows 26 and acting as the moveable portion of a fluid valve. However, in other embodiments, two separate structures interconnected together could be applied.

The second valve 66 can include the valve member 46 and a valve seat 72. The valve seat 72 can be mounted on the manifold 16 and cooperate with the valve member 46 to selectively close the passageway 50. The valve seat 72 can be fixed to the manifold 16 with a collar 74. In operation, the valve member 46 can be urged along the axis 34 toward the manifold 16 until the valve member 46 contacts and seats on the valve seat 72, closing the passageway 50.

It can be desirable to minimize the pressure differential across the bellows 26, 28, the difference in pressure between an interior of either bellows and an exterior of that bellows. It is believed that relatively high pressure differentials compromise the useful life of the bellows. In the exemplary embodiment of the invention, a pressure differential can arise if one of the fluid delivery systems fails. Relatively small pressure differentials allow for movement of the rod. However, the pressure differential can spike to undesirable levels if one of the fluid delivery systems fails or if containment of the fluid in either chamber is compromised.

High pressure differentials can lead to full compression of the bellows. The bellows 26, 28 can be formed or fabricated from metal. For a fabricated bellows having welded edges, full compression of the bellows 28 can press weld beads against each other that might be radially aligned along the length of the bellows 28. For example, the manufacture of the bellows 28 might involve the formation of weld bead at the crest or trough of each bellow. If the bellows were fully compressed, these weld beads would be pressed against each other. It is believed that such an event would shorten the useful life of the bellows. However, in some operating environments at least, full compression may not be desirable for a formed bellows either.

In one example, fluid can be directed through the passageway 56, to the second chamber 24. The second bellows 28 can be compressed in response. If the control over the fluid pressure in the first chamber 22 is compromised, the second bellows 28 might be fully compressed or worse without the presence of the valve 66. First, without the valve 66, the exterior surface of the second bellows 28 could be pressed radially inward since fluid could be urged into the first chamber 22 if control over the pressure in the first chamber 22 is not maintained. However, the exemplary embodiment provides further protection of the second bellows 28 by arranging the valve 66 to close even before the second bellows 28 is fully compressed. In other words, the valve member 46 can seat on the valve seat 72 before the second bellows 28 is fully compressed. Immediately prior to the closing of the valve 66, as the second bellows 28 is being compressed, the pressure differential between the interior of the second bellows 28 and the exterior of the second bellows 28 is relatively small. The valve 66 is arranged to close during these conditions to maintain the relatively small pressure differential. The fluid inside the second bellows 28 is incompressible and cannot escape to the first chamber 22, so the wall of the bellows 28 is protected from being fully compressed along the axis 34 or radially collapsed.

The valve 64 can similarly protect the first bellows 26. Fluid can be directed through the passageway 52, to the first chamber 22. The first bellows 26 can be expanded in response. If the control over the fluid pressure in the second chamber 24 is compromised, the first bellows 26 might be fully expanded without the presence of the valve 64. The exemplary embodiment arranges the valve 64 to close before the first bellows 26 is fully expanded. In other words, the valve member 38 can seat on the valve seat 68 before the first bellows 26 is fully expanded. Immediately prior to the closing of the valve 64, as the first bellows 26 is being expanded, the pressure differential between the interior of the first bellows 26 and the exterior of the first bellows 26 is relatively small. The valve 64 is arranged to close during these conditions to maintain the relatively small pressure differential. The fluid outside the first bellows 26 is incompressible and cannot escape to the second chamber 24, so the wall of the bellows 26 is protected from being fully expanded along the axis 34.

A sealing element 76 is shown encircling the rod 60. The sealing element 76 can to seal the fluid between the rod 60 and the end cap 20. There are different choices of sealing element in the market that can be selected. What it is shown in the drawing of the exemplary embodiment it is not necessary for practicing the invention.

Figure 2:
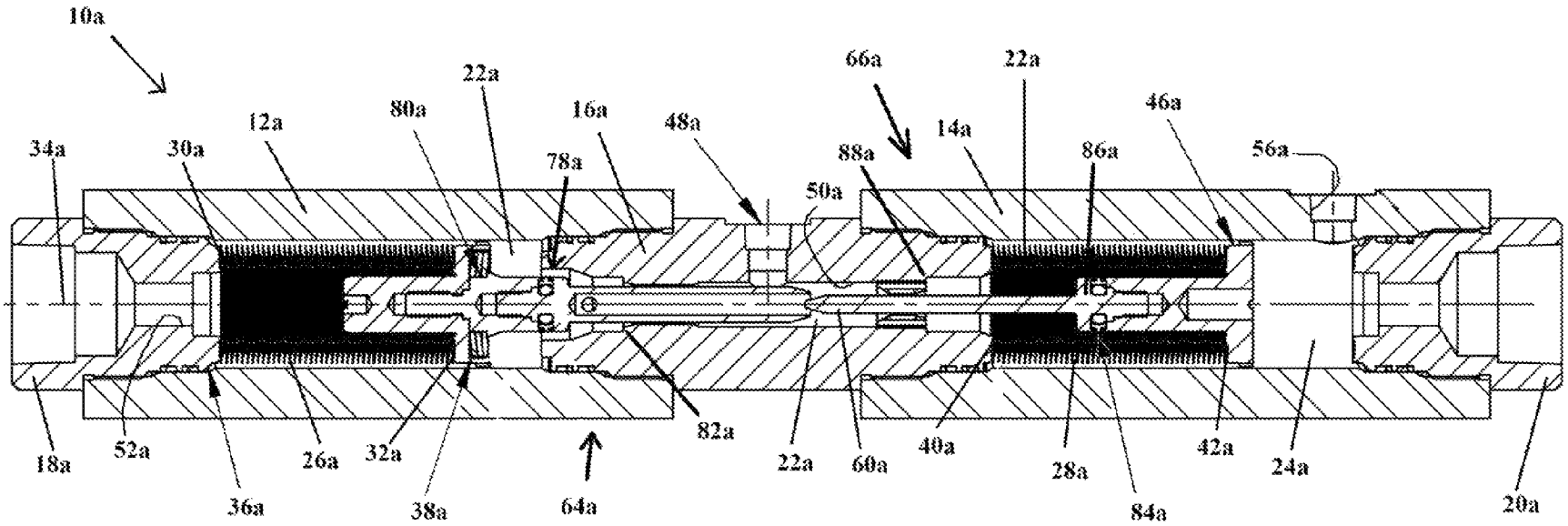
FIG. 2 is a cross-section of a second exemplary embodiment of the invention.

FIG. 2 is a cross-section of a second exemplary embodiment of the invention. FIG. 2 shows an exemplary high pressure bellows assembly 10*a*. The exemplary assembly 10*a* includes first and second housings 12*a*, 14*a*. The exemplary first and second housings 12*a*, 14*a* can be cylindrical. The exemplary assembly 10*a* can also include a manifold 16*a* interconnecting the first and second housings 12*a*, 14*a*. The manifold 16*a* can be welded to both of the first and second housings 12*a*, 14*a*. Other methods and arrangements for interconnecting the first and second housings 12*a*, 14*a* and the manifold 16*a*, both releasibly and permanently, can be applied in embodiments of the invention.

The assembly 10*a* can also include first and second end caps 18*a*, 20*a*. The end cap 18*a* can engage an end of the housing 12*a* opposite to the manifold 16*a*. The housing 12*a*, the end cap 18*a*, and the manifold 16*a* can cooperate with one another to define at least part of a first chamber 22*a*. The end cap 20*a* can engage an end of the housing 14*a* opposite to the manifold 16*a*. The housing 14*a*, the end cap 20*a*, and the manifold 16*a* can cooperate with one another to define at least part of a second chamber 24*a*. The end caps 18*a*, 20*a* can be releasibly or permanently engaged with the respective housing 12*a*, 14*a*.

The assembly 10*a* can also include first and second bellows 26*a*, 28*a*. The first bellows 26*a* can be positioned within the first housing 12*a* and extend between first and second ends 30*a*, 32*a* along a central axis 34*a* of the assembly 10*a*. The first end 30*a* can be fixedly engaged with the end cap 18*a* and be sealed with respect to the end cap 18*a*. A spout 36*a* can be integrally formed with the end cap 18*a* and project into the first end 30*a* of the first bellows 26*a*. A first valve member 38*a* (or valve closing member) can be sealingly engaged with the second end 32*a*. The bellows 26*a* can expand as fluid is received internally.

The second bellows 28*a* can be positioned within the second housing 14*a* and extend between first and second ends 40*a*, 42*a* along the central axis 34*a* of the assembly 10*a*. The first end 40*a* can be fixedly engaged with the manifold 16*a* and be sealed with respect to the manifold 16*a*. A second valve member 46*a* (or valve closing member) can be sealingly engaged with the second end 42*a*. The bellows 28*a* can expand as fluid is received internally.

The manifold 16*a* can include a port 48*a*. Incompressible fluid can be directed into the chamber 22*a* through the port 48*a* and the port 48*a* can then be sealed. The exemplary chamber 22*a* can include a first portion defined by the housing 12*a* and encircling the first bellows 26*a*. The exemplary chamber 22*a* can also include a second portion defined by a passageway 50*a* extending through the manifold 16*a*. The exemplary chamber 22*a* can also include a third portion being the interior of the second bellows 28*a*. As will be set forth more fully below, the first, second and third portions of the chamber 22*a* can be selectively closed from one another.

A passageway 52*a* can extend through the end cap 18*a*. The passageway 52*a* can extend through the spout 36*a* to fluidly communicate with the interior of the first bellows 26*a*. A fluid delivery system, such as one referenced schematically at 54 in FIG. 1, can be used to selectively direct pressurized fluid to the passageway 52*a* and thus to the interior of the first bellows 26*a*. Fluid can be selectively directed into the interior of the first bellows 26*a* and selectively allowed to exit the interior of the first bellows 26*a*.

A passageway 56*a* can extend through the housing 14*a*. The passageway 56*a* can fluidly communicate with the chamber 24*a*. A fluid delivery system, such as one referenced schematically at 58 in FIG. 1, can be used to selectively direct pressurized fluid to the passageway 56*a* and thus to the chamber 24*a*. It is noted that in some embodiments of the invention a single fluid delivery system can be applied; the fluid delivery systems can be sub-systems of single, comprehensive system controlled by a single controller. Fluid can be selectively directed into the chamber 24*a* and selectively allowed to exit the chamber 24*a*.

The second valve member 46*a* can be integrally-formed with or engaged with a rod 60*a*. The rod 60*a* can project through a passageway 50*a* in the end manifold 16*a*. The rod 60*a* can assist in keeping motion of the valve member 46*a* along the axis 34*a*.

The assembly includes first and second valves 64*a* and 66*a* to protect the bellows 26*a* and 28*a* from damage that can arise when large pressure differentials arise between the outside and inside of either of the bellows 26*a*, 28*a*. The first valve 64*a* can include the valve member 38*a* and a radial seal 78*a*. The radial seal 78*a* can be mounted on a seal holder 80*a* fixed to the valve member 38*a*. The manifold 16*a* also cooperates to selectively close the passageway 50*a*. In operation, the valve member 38*a* can be urged along the axis 34*a* toward the manifold 16*a* until the seal holder 80*a* contacts is positively stopped by a shoulder 82*a* defined in the passageway 50*a*. When that occurs, the radial seal 78*a* is sealing engaged with the passageway 50*a* and the passageway 50*a* is thus closed.

The second valve 66*a* can include the valve member 46*a* and a radial seal 84*a*. The radial seal 84*a* can be mounted on a seal holder 86*a* fixed to the valve member 46*a*. The manifold 16*a* also cooperates with the second valve member 66*a* to selectively close the passageway 50*a*. In operation, the valve member 46*a* can be urged along the axis 34*a* toward the manifold 16*a* until the seal holder 86*a* contacts is positively stopped by a shoulder 88*a* defined in the passageway 50*a*. When that occurs, the radial seal 78*a* is sealing engaged with the passageway 50*a* and the passageway 50*a* is thus closed.

It can be desirable to minimize the pressure differential across the bellows 26*a*, 28*a*, the difference in pressure between an interior of either bellows and an exterior of that bellows. It is believed that relatively high pressure differentials compromise the useful life of the bellows. In the exemplary embodiment of the invention, a pressure differential can arise if one of the fluid delivery systems fails. Relatively small pressure differentials allow for movement of the rod. However, the pressure differential can spike to undesirable levels if one of the fluid delivery systems fails or if containment of the fluid in either chamber is compromised.

High pressure differentials can lead to full compression of the bellows. The bellows 26*a*, 28*a* can be formed or fabricated from metal. For a fabricated bellows having welded edges, full compression of the bellows 28*a* can press weld beads against each other that might be radially aligned along the length of the bellows 28*a*. For example, the manufacture of the bellows 28*a* might involve the formation of weld bead at the crest or trough of each bellow. If the bellows were fully compressed, these weld beads would be pressed against each other. It is believed that such an event would shorten the useful life of the bellows. However, in some operating environments at least, full compression may not be desirable for a formed bellows either.

In one example, fluid can be directed through the passageway 56*a*, to the second chamber 24*a*. The second bellows 28*a* can be compressed in response. If the control over the fluid pressure in the first chamber 22*a* is compromised, the second bellows 28*a* might be fully compressed or worse without the presence of the valve 66*a*. First, without the valve 66*a*, the exterior surface of the second bellows 28*a* could be pressed radially inward since fluid could be urged into the first chamber 22*a* if control over the pressure in the first chamber 22*a* is not maintained. However, the exemplary embodiment provides further protection of the second bellows 28*a* by arranging the valve 66*a* to close even before the second bellows 28*a* is fully compressed. In other words, the valve member 46*a* can be positively stopped from moving before the second bellows 28*a* is fully compressed. Immediately prior to the closing of the valve 66*a*, as the second bellows 28*a* is being compressed, the pressure differential between the interior of the second bellows 28*a* and the exterior of the second bellows 28*a* is relatively small. The valve 66*a* is arranged to close during these conditions to maintain the relatively small pressure differential. The fluid inside the second bellows 28*a* is incompressible and cannot escape to the first chamber 22*a*, so the wall of the bellows 28*a* is protected from being fully compressed along the axis 34*a* or radially collapsed.

The valve 64*a* can similarly protect the first bellows 26*a*. Fluid can be directed through the passageway 52*a*, to the first chamber 22*a*. The first bellows 26*a* can be expanded in response. If the control over the fluid pressure in the second chamber 24*a* is compromised, the first bellows 26*a* might be fully expanded without the presence of the valve 64*a*. The exemplary embodiment arranges the valve 64*a* to close and the valve member 38*a* is positively stopped before the first bellows 26*a* is fully expanded. In other words, the valve member 38*a* can abut the shoulder 82*a* before the first bellows 26*a* is fully expanded. Immediately prior to the closing of the valve 64*a*, as the first bellows 26*a* is being expanded, the pressure differential between the interior of the first bellows 26*a* and the exterior of the first bellows 26*a* is relatively small. The valve 64*a* is arranged to close during these conditions to maintain the relatively small pressure differential. The fluid outside the first bellows 26*a* is incompressible and cannot escape to the second chamber 24*a*, so the wall of the bellows 26*a* is protected from being fully expanded along the axis 34*a*.

Figure 3:
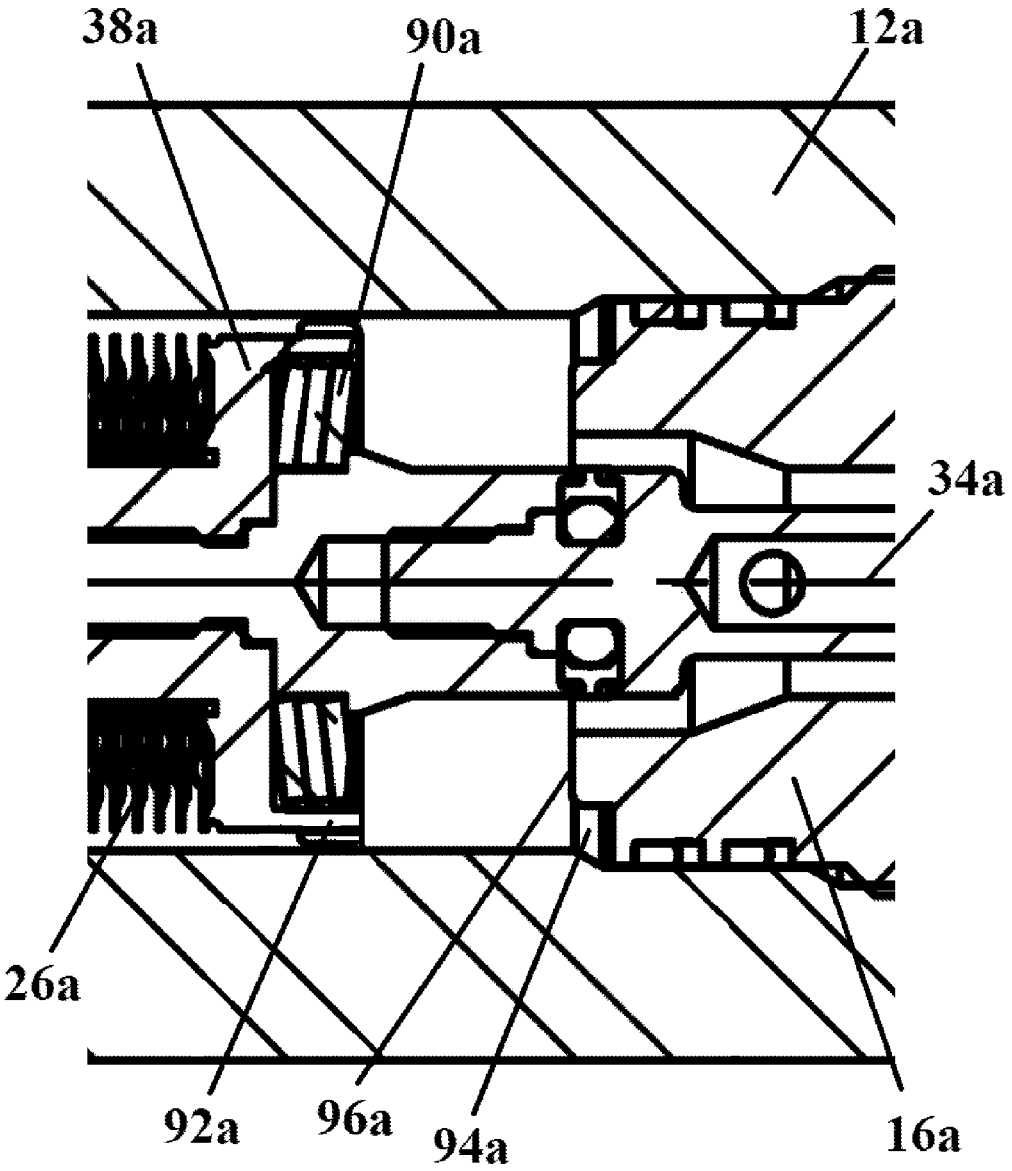
FIG. 3 is a magnified portion of FIG. 2.

Another feature of the second embodiment is a secondary pressure absorption arrangement. FIG. 3 is a magnified portion of FIG. 2. The valve member 38*a* defines annular groove extending about the axis 34*a*. A Belleville washer 90*a* is disposed in the groove. When the valve member 38*a* moves as the first bellows 26*a* is expanded, a ring-like distal end 92*a* of the valve member 38*a* (which encircles the washer 90*a*) is received in a groove 94*a* defined by the manifold 16*a*. At some point during movement of the valve member 38*a* during expansion of the bellows 26*a*, the washer 90*a* contacts an end face 96*a* of the manifold. Expansion of the bellows 26*a* beyond this point causes elastic deformation of the washer 90*a*, as the washer 90*a* is compressed with decreasing distance between the end face 96*a* and the bottom of the annular groove of the valve member 38*a*.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. A high pressure bellows assembly comprising:
- a first bellows being reversibly expandable;
- a second bellows being reversibly expandable;
- a chamber including a first portion encircling said first bellows, a second portion including an interior of said second bellows, and a third portion placing the first and second portion in fluid communication;
- a first valve member disposed with said chamber between said first and third portions; and
- a second valve member disposed with said chamber between said first and second portions.

2. The high pressure bellows assembly of claim 1 wherein:
- said first valve member encloses a first end of said first bellows; and
- said second valve member encloses a first end of said second bellows.

3. The high pressure bellows assembly of claim 1 further comprising:
- a secondary pressure absorption arrangement including an annular groove in said first valve member and a washer disposed in said annular groove.

4. The high pressure bellows assembly of claim 1 wherein:
- said first valve member is disposed at a first moveable end of said first bellows; and
- said second valve member is disposed at a first moveable end of said second bellows.

5. The high pressure bellows assembly of claim 4 wherein said first valve member and said first end of said first bellows are operable to move away from a second end of said first bellows as said first bellows expands and said second valve member and said first end of said second bellows are operable to move away from a second end of said second bellows as said second bellows expands.

6. The high pressure bellows assembly of claim 4 wherein said first valve member and said first end of said first bellows move toward said first valve seat during movement away from a second end of said first bellows as said first bellows expands and said second valve member and said first end of said second bellows move away from said second end of said second bellows and said second valve seat as said second bellows expands.

7. The high pressure bellows assembly of claim 4 further comprising first and second valve seats disposed in said chamber respectively positioned at opposite ends of said third portion of said chamber.

8. The high pressure bellows assembly of claim 7 wherein said first valve member moves away from said first valve seat as said first bellows contracts and said second valve member moves toward said second valve seat as said second bellows contracts.

9. The high pressure bellows assembly of claim 8 wherein said first valve member contacts said first valve seat and closes said first and third portions of said chamber with respect to one another when said first bellows is less than fully expanded.

10. The high pressure bellows assembly of claim 8 wherein said second valve member contacts said second valve seat and closes said first and third portions of said chamber with respect to one another when said second bellows is less than fully contracted.

11. The high pressure bellows assembly of claim 1 further comprising:

a manifold defining the third portion of the chamber.

12. The high pressure bellows assembly of claim 11 wherein said manifold only contacts one of said first and second bellows.

13. A method for assembling a high pressure bellows assembly comprising the steps of:

providing a first bellows being reversibly expandable, wherein pressurized fluid is capable of being selectively directed into and out of the first bellows;

providing a second bellows being reversibly expandable, wherein pressurized fluid is capable of being selectively directed into and out of the second bellows; and interconnecting the first bellows and the second bellows by defining a chamber including a first portion encircling the first bellows, a second portion including an interior of the second bellows, and a third portion placing the first and second portion in fluid communication with one another fixing respective first ends of each of the first and second bellows;

disposing a first valve seat between the first and third portions and a second valve seat between the second and third portions; and mounting respective first and second valve closing members operable to sealingly engage the respective first and second valve seats on the respective second ends of each of the first and second bellows.

14. The method of claim 13 further comprising the step:

sizing at least one of the first bellows, the first valve closing member, and the first valve seat whereby the first bellows is neither fully expanded or fully contracted when the first valve closing member is sealingly engaged with first valve seat.

15. The method of claim 13 further comprising the step:

sizing at least one of the second bellows, the second valve closing member, and the second valve seat whereby the second bellows is neither fully expanded or fully contracted when the second valve closing member is sealingly engaged with second valve seat.

16. A high pressure bellows assembly comprising:

a first housing extending between first and second ends;

a first bellows being reversibly expandable and extending between first and second ends and disposed in said first housing;

a first end cap mounted at said first end of said first housing and fixedly engaged with said first end of said first bellows, said first end cap including aperture for directing pressurized fluid into said first bellows;

a second housing extending between first and second ends;

a second bellows being reversibly expandable and extending between first and second ends and disposed in said first housing;

a manifold disposed between and interconnecting said second end of said first housing and said first end of said second housing said manifold fixedly engaged with said first end of said second bellows and including aperture for directing pressurized fluid into said second bellows; and a chamber including a first portion defined between said first housing and said first bellows and said manifold, a second portion including an interior of said second bellows, and a third portion defined by said manifold and placing the first and second portion in fluid communication.

17. The high pressure bellows assembly of claim 16 further comprising:

a first valve closing member mounted on said second end of said first bellows and enclosing an interior of said first bellows; and a first valve seat mounted at a first end of said third portion and disposed within said first portion, wherein said first valve closing member sealingly engages said first valve seat, whereby said first portion is closed off from said second and third portions, when said first bellows expands to a less than fully-expanded condition.

18. The high pressure bellows assembly of claim 17 a second valve closing member mounted on said second end of said second bellows and enclosing an interior of said second bellows; and a second valve seat mounted at a second end of said third portion and disposed within said second portion, wherein said second valve closing member sealingly engages said second valve seat, whereby said second portion is closed off from said first and third portions, when said second bellows contracts to a less than fully-contracted condition.

* * * * *